US008403437B2

(12) United States Patent
Bergmann et al.

(10) Patent No.: US 8,403,437 B2
(45) Date of Patent: Mar. 26, 2013

(54) VERSATILE REFRIGERATOR CRISPER SYSTEM

(75) Inventors: Tim A. Bergmann, Cedar Rapids, IA (US); Bradley Thomas Hebeler, Blue Grass, IA (US); Douglas A. Pohl, Benttendorf, IA (US)

(73) Assignee: Whirlpool Corporation, Benton Harbor, MI (US)

( * ) Notice: Subject to any disclaimer, the term of this patent is extended or adjusted under 35 U.S.C. 154(b) by 1359 days.

(21) Appl. No.: 11/033,528

(22) Filed: Jan. 12, 2005

(65) Prior Publication Data

US 2005/0156494 A1 Jul. 21, 2005

Related U.S. Application Data

(60) Provisional application No. 60/536,842, filed on Jan. 16, 2004.

(51) Int. Cl.
*A47B 96/00* (2006.01)
*A47B 88/04* (2006.01)

(52) U.S. Cl. ..... 312/404; 312/334.1

(58) Field of Classification Search ..... 312/404, 312/408, 330.1, 334.1, 334.7, 334.18, 334.21, 312/334.16, 402; 62/382
See application file for complete search history.

(56) References Cited

U.S. PATENT DOCUMENTS

| | | | | |
|---|---|---|---|---|
| 1,840,141 | A | | 1/1932 | Vanderhoof |
| 2,292,865 | A | | 8/1942 | Boddy |
| 2,306,802 | A | | 12/1942 | Harbison |
| 2,573,272 | A | | 10/1951 | Petkwitz |
| 4,173,380 | A | | 11/1979 | Dupree |
| 4,494,802 | A | * | 1/1985 | Henson ..... 384/19 |
| 4,870,836 | A | | 10/1989 | Pink |
| 4,960,308 | A | | 10/1990 | Donaghy |
| 5,040,856 | A | * | 8/1991 | Wilkins et al. ..... 312/402 |
| 5,470,144 | A | * | 11/1995 | Wen ..... 312/334.13 |
| 5,484,199 | A | | 1/1996 | Gasser et al. |
| 5,577,823 | A | * | 11/1996 | Maglinger ..... 312/404 |
| 5,641,217 | A | | 6/1997 | Caruso et al. |
| 5,918,959 | A | * | 7/1999 | Lee ..... 312/404 |
| 5,947,574 | A | | 9/1999 | Avendano |
| 5,984,442 | A | * | 11/1999 | Hellman, Jr. ..... 312/334.12 |
| 6,148,813 | A | * | 11/2000 | Barnes et al. ..... 126/339 |
| 6,170,276 | B1 | | 1/2001 | Mandel et al. |
| 6,193,340 | B1 | * | 2/2001 | Schenker et al. ..... 312/265.5 |
| 6,343,477 | B1 | | 2/2002 | Mandel et al. |

FOREIGN PATENT DOCUMENTS

| | | |
|---|---|---|
| JP | 11-108549 | 4/1999 |
| JP | 2001-116446 | 4/2001 |

* cited by examiner

*Primary Examiner* — James O Hansen
(74) *Attorney, Agent, or Firm* — Kirk W. Goodwin; Diederiks & Whitelaw PLC

(57) ABSTRACT

A refrigerator includes a multiple slide crisper system. More specifically, a universal crisper pan and support frame for a refrigerator can be used with various, distinct glide arrangements, including friction, roller or ball bearing glides. For frictional sliding movement, crisper pan side walls slide directly upon molded inner rails on the frame. With the roller system, various rollers are fitted to a rear portion of the crisper pan through the use of pins, while commensurate rollers are mounted at front portions of the frame. When using ball bearing glides for a precision slide support, the glides are preferably mounted to the support frame at an acute angle to the axis of travel of the friction and roller glide systems.

20 Claims, 15 Drawing Sheets

VERSATILE REFRIGERATOR CRISPER SYSTEM

CROSS-REFERENCE TO RELATED APPLICATIONS

The present application claims the benefit of U.S. Provisional Patent Application Ser. No. 60/536,842 filed Jan. 16, 2004.

BACKGROUND OF THE INVENTION

1. Field of the Invention

The present invention pertains to the art of refrigerators and, more particularly, to a crisper system which enables a single crisper drawer, pan or bin to be slidably supported in any one of at least three distinct ways.

2. Discussion of the Prior Art

In the art of refrigerators, particularly household refrigerators, it is often desirable to create varying humidity and/or temperature controlled storage zones to enhance the preservation of different food items. For instance, it is common to accommodate the storage requirements for certain food items, such as dairy products, meats, fruits and vegetables, by forming separately enclosed storage areas within a fresh food compartment. In most instances, these storage areas are designed to be maintained at temperature and/or humidity levels which are different from the control levels of the remainder of the fresh food compartment.

In particular, it is known to provide a crisper pan at the bottom portion of a fresh food compartment, wherein the crisper pan is slidably mounted in one of various distinct ways. In each case, the overall mounting arrangement includes a support frame, which can also establish a shelf within the fresh food compartment, and a crisper pan slidably supported from the frame. Depending upon the particular manner in which the crisper pan is to be slidably supported, both a unique support frame and a unique crisper pan are employed. Therefore, when a certain slide system is selected, such as a friction, roller or ball bearing glide system, a dedicated support frame/crisper pan combination is utilized.

When utilizing a roller glide system, multiple rollers must be supported on each of the crisper pan and the support frame. In the art, it is common to employ one of two types of fastening arrangements for the rollers. The first arrangement utilizes screws. Most often, both the crisper pan and the support frame are molded of a plastic material, such as polycrystal styrene. When driving a screw into styrene, extreme care must be taken to avoid cracking of the material. The second fastening arrangement employs a snap-fit attachment for the rollers. Unfortunately, although assembly is more reliable, such a roller arrangement has not been found to be particularly robust. Specifically, it has been found that the wheel of the roller often ends up dragging, instead of rolling. Obviously, this defeats the potential advantage of using rollers instead of a friction glide system.

Although designing dedicated combination support frame and crisper pan systems is plausible and commonplace, it would be beneficial to provide a universal support frame and crisper pan system wherein a single support frame can be utilized with a single crisper pan while enabling the crisper pan to be slidably supported by the support frame through a selected one of friction, roller and ball bearing glide arrangements. Therefore, there exists a need in the art of refrigerators for a multiple slide crisper system which will enable a single crisper drawer, pan or bin to be slidably supported in any one of at least three distinct ways, including the use of friction, roller or ball bearing glide systems.

SUMMARY OF THE INVENTION

The present invention is directed to a versatile crisper system for a refrigerator. More specifically, a universal crisper pan and support frame for a refrigerator can be used with multiple, distinct glide arrangements, including friction, roller or ball bearing glides. For frictional sliding movement, crisper pan side walls slide directly upon molded inner rails on the frame. In addition, a stop arrangement, including engaging stop elements, is provided between the crisper pan and the support frame to limit the permissible degree of travel of the crisper pan into and out of the fresh food compartment.

With the roller system, various rollers are fitted to a rear portion of the crisper pan through the use of pins, while commensurate rollers are mounted at front portions of the frame. In the most preferred embodiment, the rollers are made of nylon, while the pins are formed from acetal. These materials cooperate to create a superior bearing arrangement. In this manner, the pan is slidably supported through the rollers at multiple fore-to-aft locations through a simple and reliable configuration. Preferably, the stop arrangement employed with the friction slide system is also utilized with the roller support arrangement.

When using ball bearing glides for a precision slide support, the glides are mounted to the support frame at an acute angle to the axis of travel of the friction and roller glide systems. With this arrangement, as the crisper pan moves forward, the pan rises enough to clear the stop elements on the crisper pan and support frame, while the ball bearing glides themselves have built-in stops. In addition, the angling enhances the closing of the crisper pan.

Additional objects, features and advantages of the present invention will become more readily apparent from the following detailed description of preferred embodiments when taken in conjunction with the drawings wherein like reference numerals refer to corresponding parts in the several views.

DETAILED DESCRIPTION OF THE PREFERRED EMBODIMENTS

Figure 1:
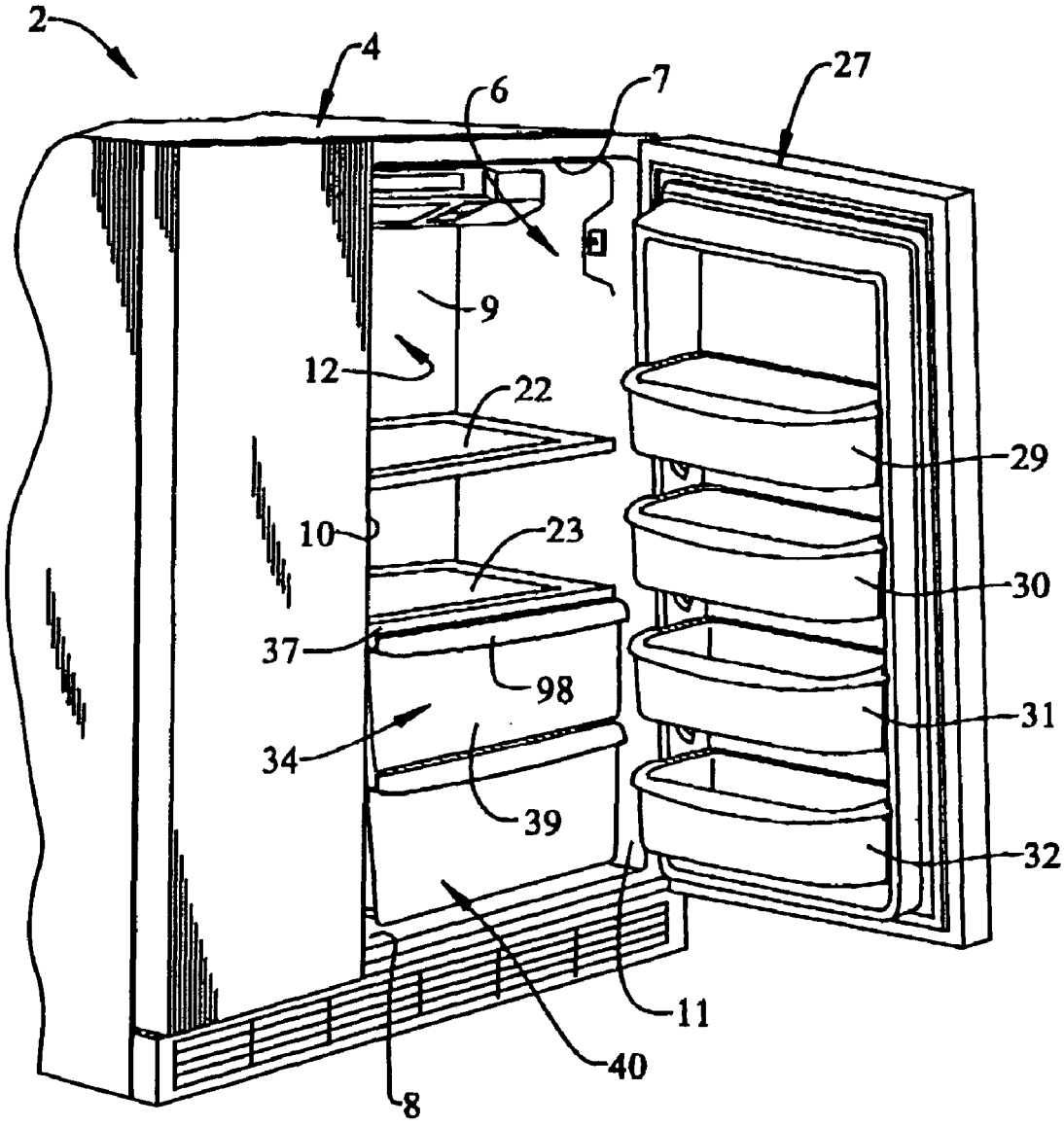
FIG. 1 is a partial perspective view of a refrigerator incorporating a versatile refrigerator crisper system constructed in accordance with the present invention.
Figure 2:
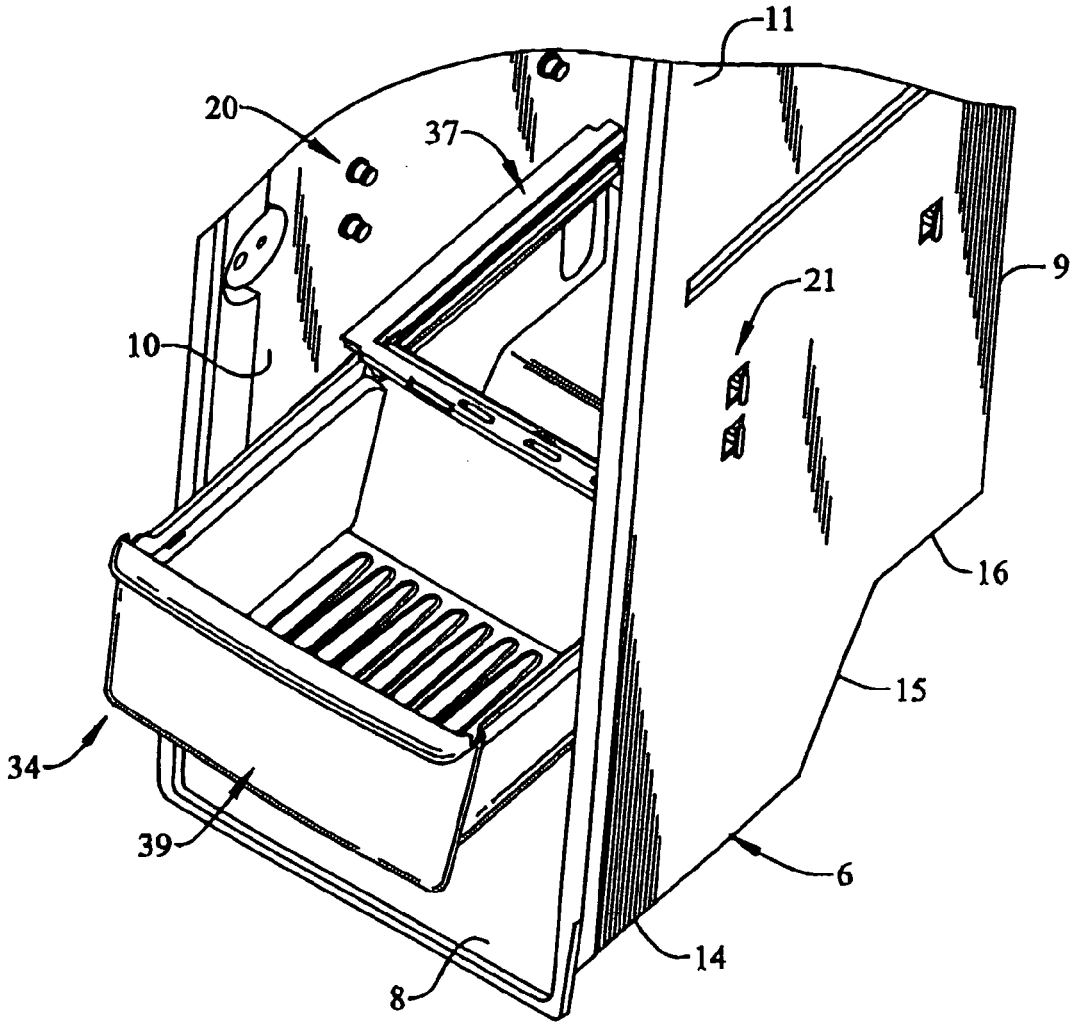
FIG. 2 is a partial perspective view of a refrigerator fresh food liner incorporating the versatile refrigerator crisper system of the present invention in a lower portion thereof.

With initial reference to FIGS. 1 and 2, a refrigerator constructed in accordance with the present invention is generally shown at 2. Refrigerator 2 is shown to include a cabinet shell 4 within which is secured a liner 6. As shown, liner 6 includes top, bottom, rear and opposing side walls 7-11 that collectively define a fresh food compartment 12. In the embodiment shown, bottom wall 8 includes a first substantially horizontal portion 14 which leads to an angled portion that extends to and connects with rear wall 9 through a second substantially horizontal portion 16. Angled portion 15 creates an offset in liner 6 to accommodate, for example, various refrigerator components including a compressor (not shown). In a manner known in the art, liner 6 is provided with a plurality of support elements indicated generally at and 21 which are provided on opposing side walls 10 and 111 respectively. Support elements 20 and 21 are adapted to support, for example, a shelf 22, as well as additional storage units one of which is shown supporting a shelf 23. In any event, the particular details of the additional storage units will be provided more fully below. In addition, refrigerator 2 is shown to include a door 27 which is adapted to selectively close fresh food compartment 12. In a manner known in the art, door 27 is provided with a plurality of bins 29-32 for supporting various food stuffs or other items.

In accordance with the invention, refrigerator 2 is provided with a universal crisper drawer system indicated generally at 34. In the embodiment shown, crisper drawer system 34 includes a support frame 37 and a crisper bin or pan 39. Of course, additional crisper drawer systems could be provided, such as indicated at 40. As will be discussed more fully below, support frame 37 and crisper pan 39 are configured such that crisper pan 39 is shiftably mounted relative to support frame 37 through a variety of distinct glide systems. Thus, depending upon particular model design requirements or consumer needs, a single crisper pan 39 and support frame 37 can be configured to accept a variety of glide systems without the need to substantially alter either component.

Figure 3:
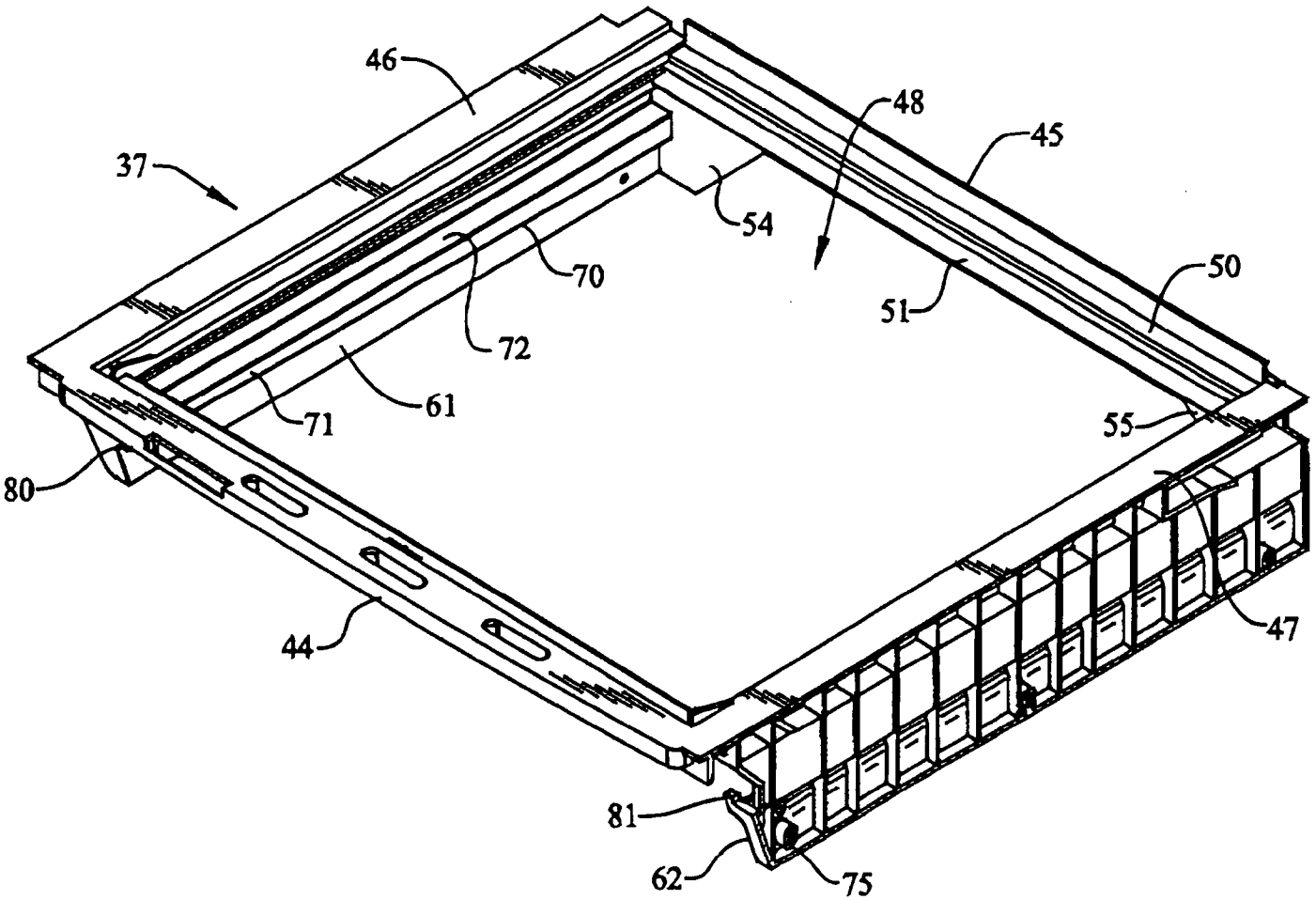
FIG. 3 is a perspective view of a support frame portion of the refrigerator crisper system of the invention.
Figure 4:
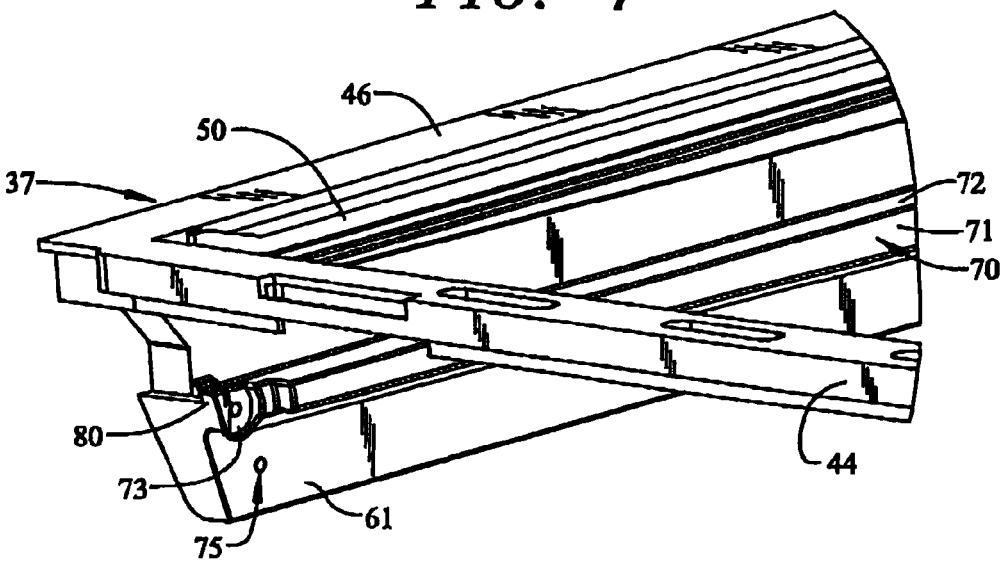
FIG. 4 is an enlarged perspective view of a front left corner of the support frame of FIG. 3.

Reference will now be made to FIGS. 3 and 4 in describing support frame 37 configured in accordance with a first embodiment of the present invention. As shown, support frame 37 includes a front edge portion 44, as well as back and opposing side wall portions 45-47 which collectively define an opening 48. In the embodiment shown, extending from front, back and opposing side wall portions 44-47 about opening 48 is a first inner ledge 50. In a manner known in the art, first inner ledge 50 is provided so as to support for example shelf 23. In addition to first inner ledge 50, back wall 45 is provided with a second or inner support ledge 51. As will be discussed more fully below, second support ledge 51 is adapted to partially support crisper pan 39. Back wall 45 is also provided with a pair of gussets 54 and 55 which provide increased structural support for support frame 37 that enable crisper pan 39 to store heavy items such as potatoes and the like.

As best shown in FIG. 3, opposing side wall portions 46 and 47 are provided with corresponding first and second inner rails 61 and 62 which, as will be detailed more fully below, can be configured for receiving various glide systems. In accordance with the invention, first and second inner rails 61 and 62 include a first pair of glide elements 70. In the embodiment shown, first pair of glide elements 70 is constituted by a longitudinal rib 71 having a corresponding glide surface 72. In addition to first pair of glide elements 70, support frame 37 includes a first pair of mounting elements 73 (see FIG. 4), as well as a second pair of mounting elements indicated generally at 75. Furthermore, in order to limit the overall outward travel of crisper pan 39, support frame 37 is provided with a pair of end or travel stops 80 and 81 which are arranged on a front portion (not separately labeled) of first and second inner rails 61 and 62.

Figure 5:
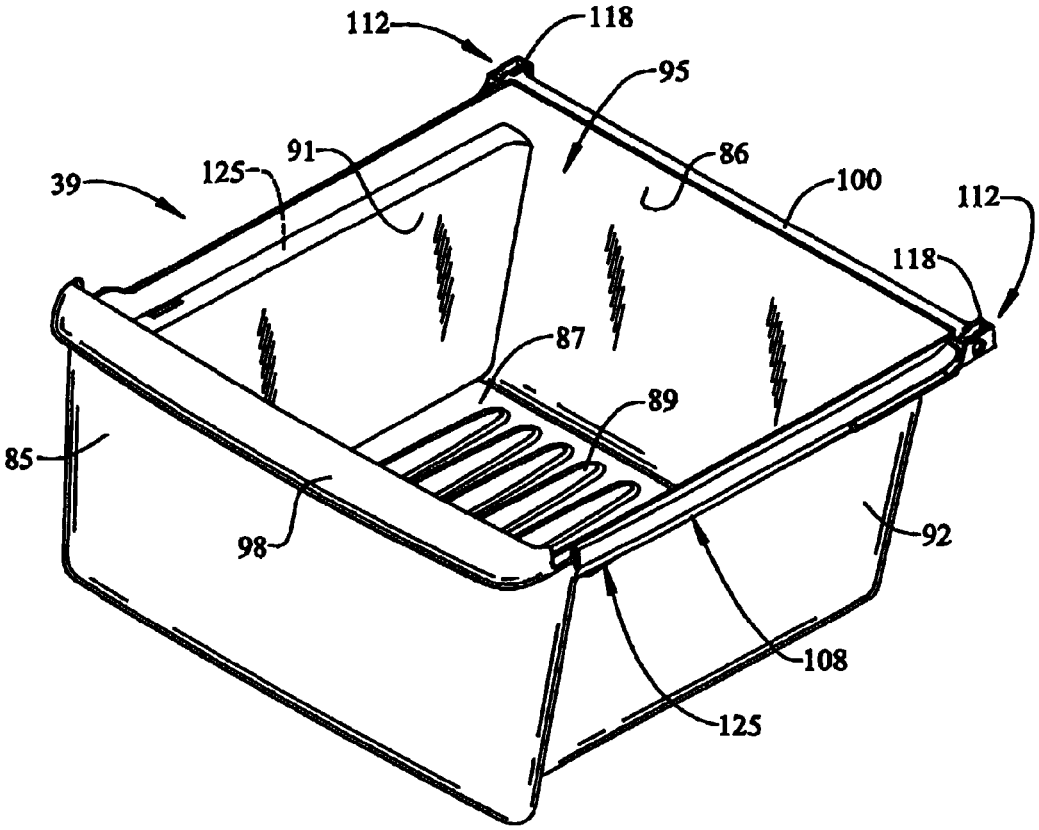
FIG. 5 is a perspective view of a crisper pan portion of the refrigerator crisper system of the invention.
Figure 6:
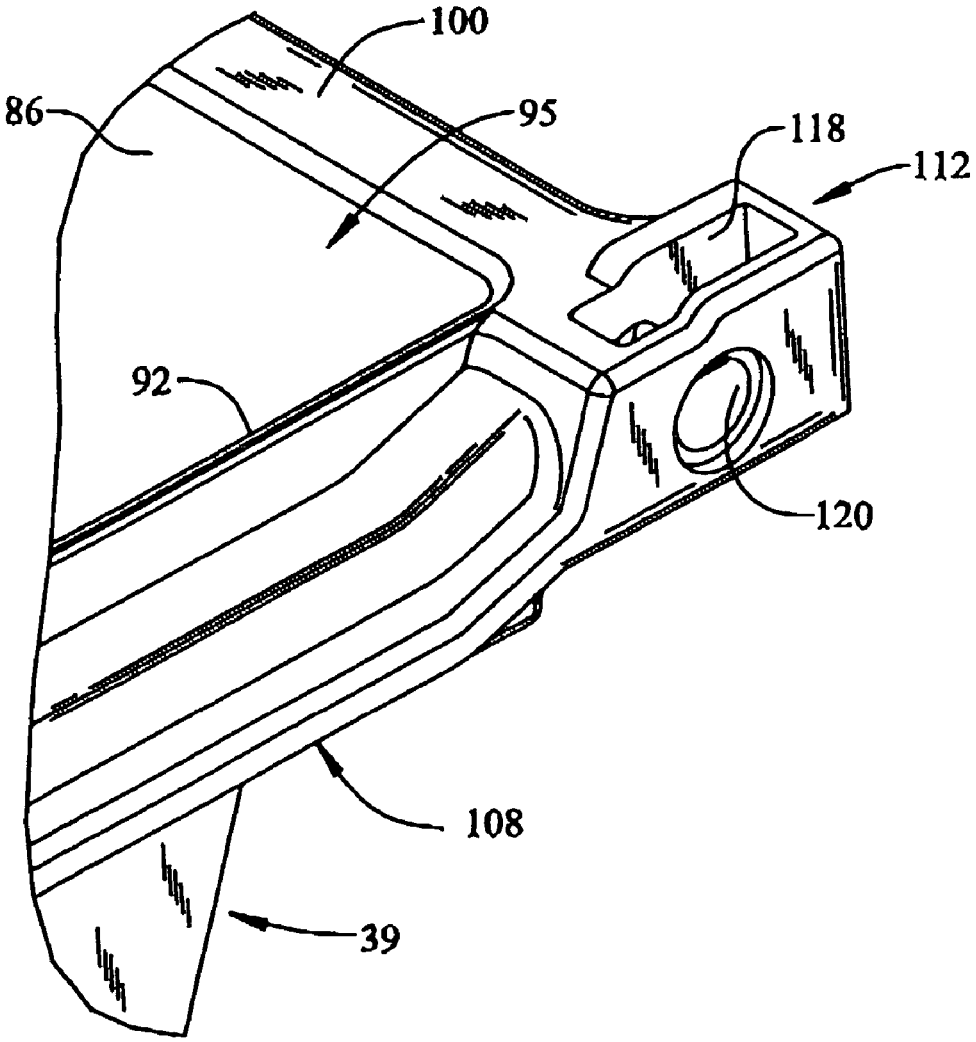
FIG. 6 is an enlarged perspective view of a rear corner portion of the crisper pan of FIG. 5.

Reference will now be made to FIGS. 5 and 6 in describing a preferred construction of crisper pan 39. As shown, crisper pan 39 includes a front wall 85, a rear wall 86, bottom wall 87 having a plurality of raised portions, one of which is indicated at 89, as well as a pair of opposing side walls 91 and 92 which collectively define a storage cavity 95. In a manner known in the art, front wall 85 includes a handle 98 which enables a consumer to grasp and selectively withdraw crisper pan 39 from support frame 37. Also, rear wall 86 is provided with a flange 100.

Figure 7:
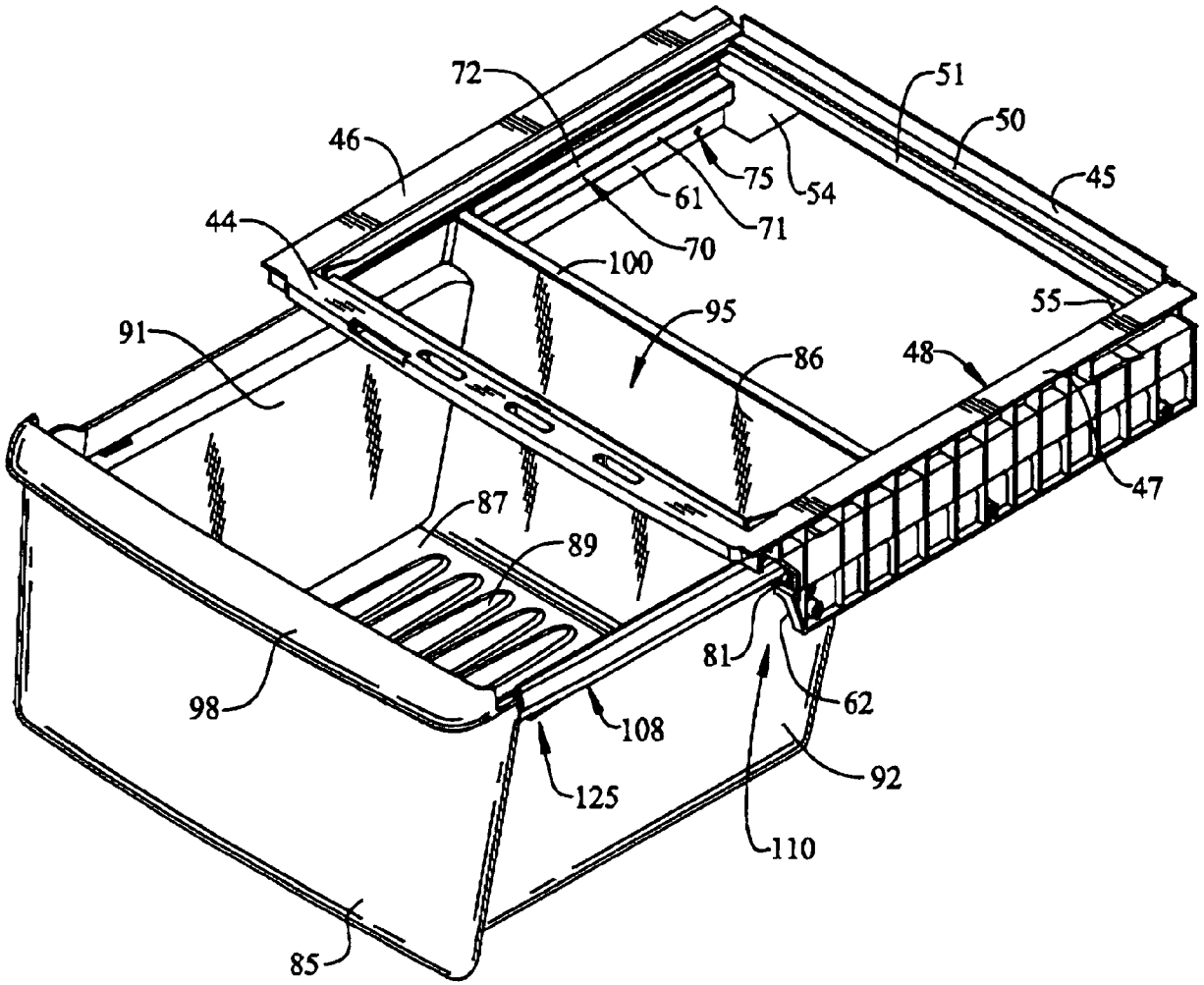
FIG. 7 is an upper right perspective view illustrating the overall refrigerator crisper system assembled in accordance with a first embodiment of the present invention.
Figure 8:
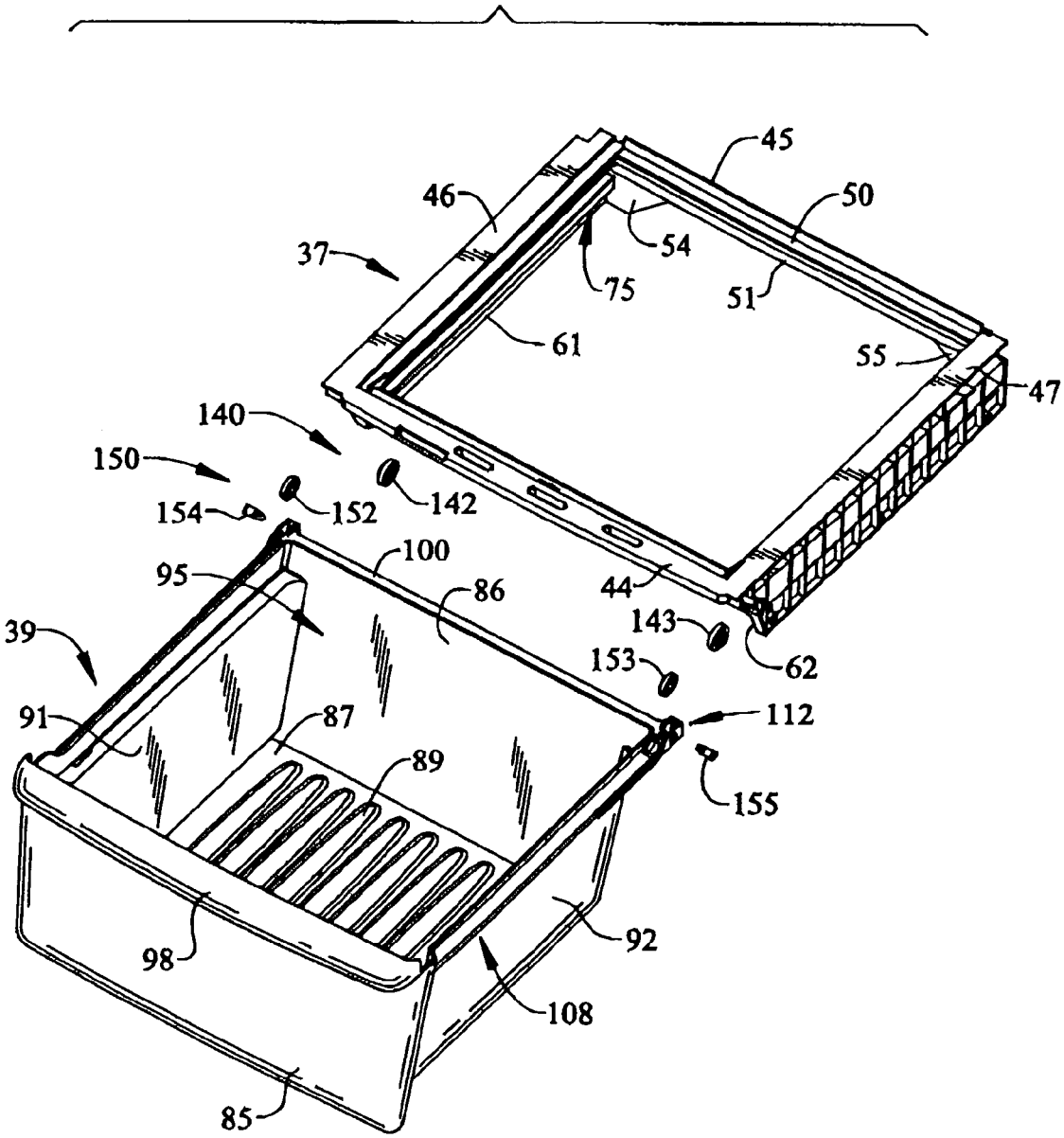
FIG. 8 is an exploded view illustrating the refrigerator crisper system in accordance with a second embodiment of the invention.
Figure 9:
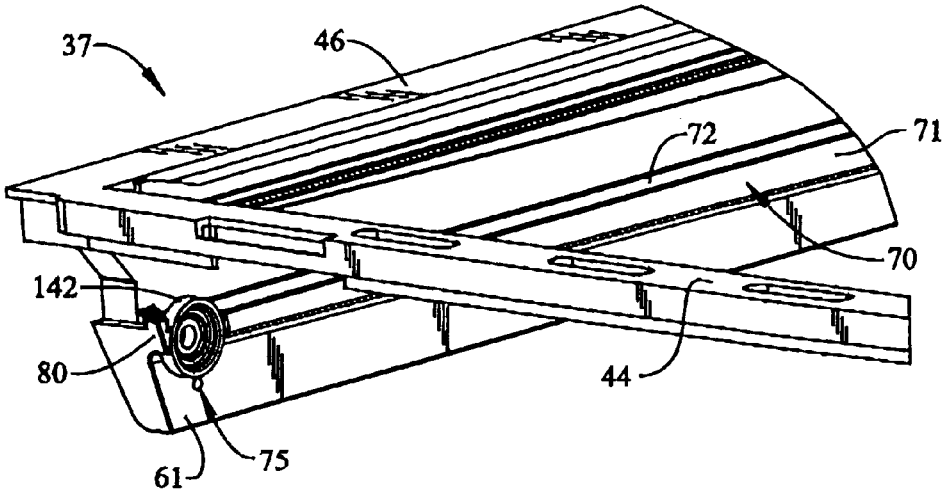
FIG. 9 is an enlarged perspective view of a front left corner of the support frame of FIG. 8 in accordance with the second embodiment.
Figure 10:
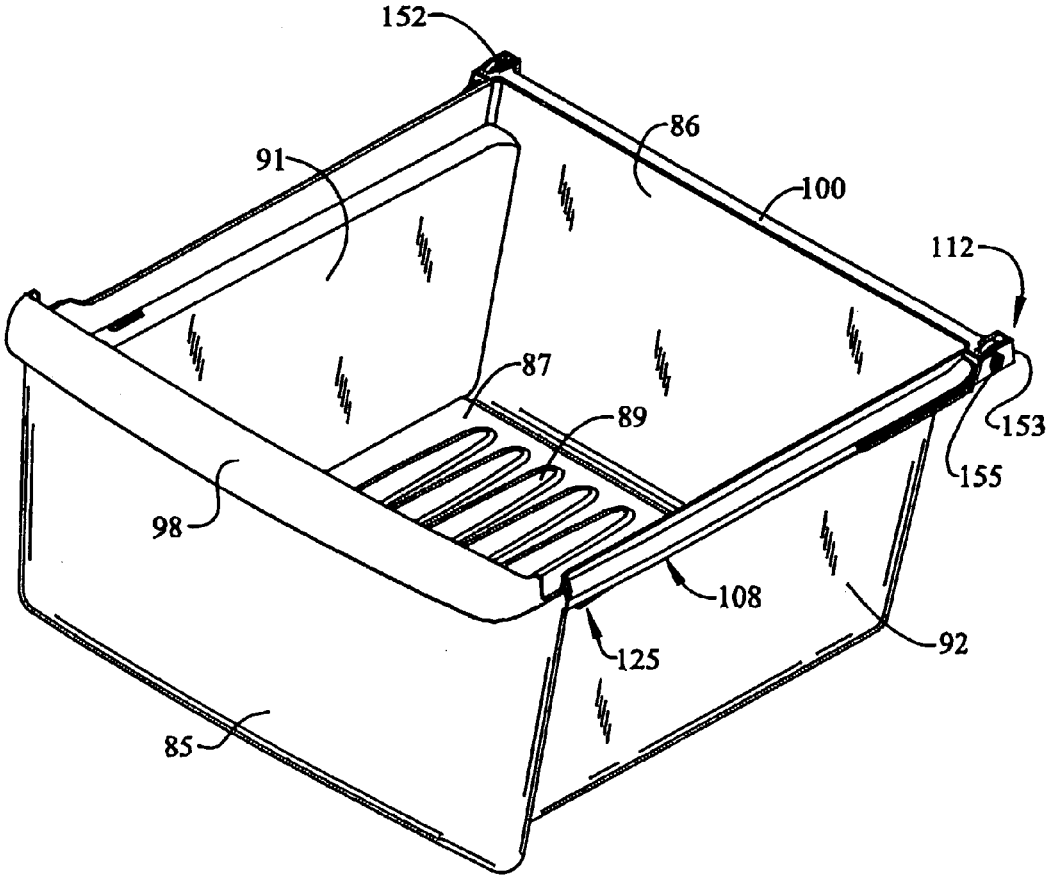
FIG. 10 is a perspective view of the crisper pan constructed in accordance with the second embodiment of the present invention.
Figure 11:
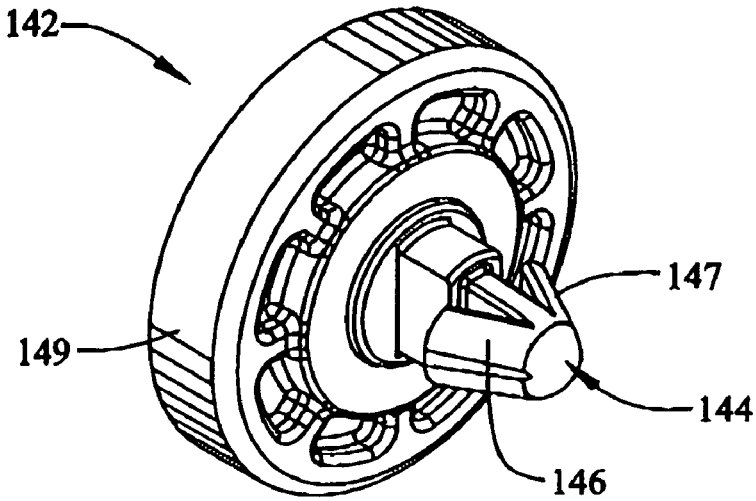
FIG. 11 is a perspective view of a snap-in roller employed in accordance with the second embodiment of the invention.
Figure 12:
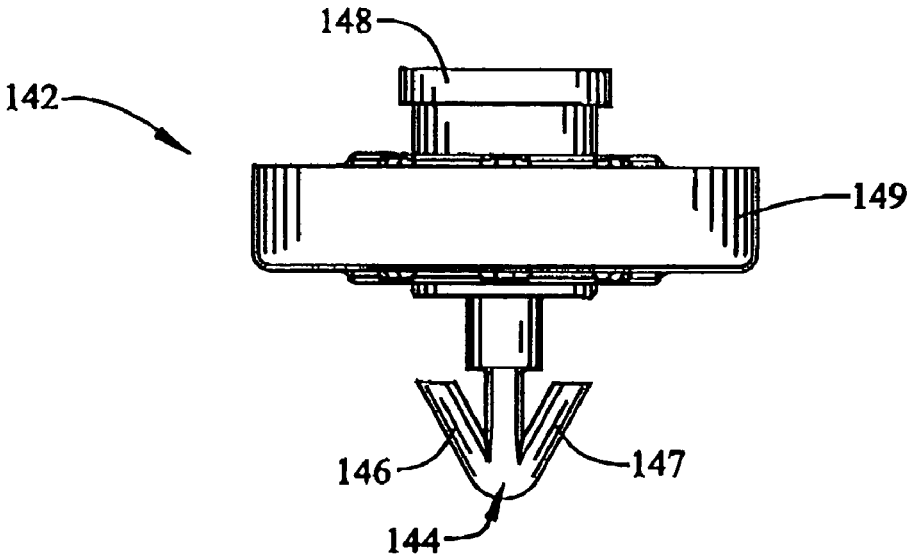
FIG. 12 is a top view of the roller of FIG. 11.
Figure 13:
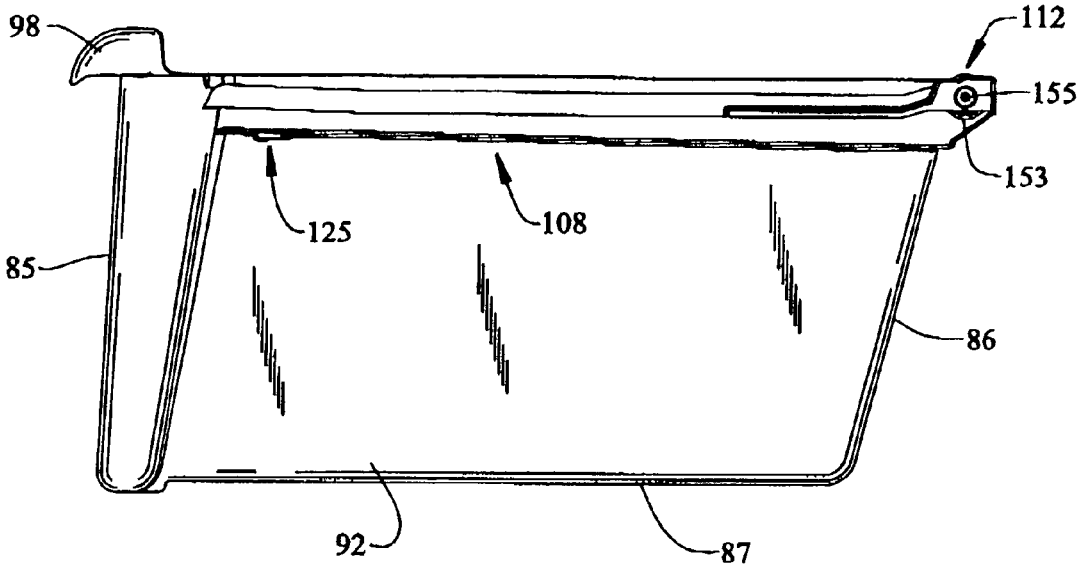
FIG. 13 is a side elevational view of the crisper pan of FIG. 10 in accordance with the second embodiment.

In a manner analogous to that set forth above with respect to support frame 37, crisper pan 39 is provided with a first pair of glide members, one of which is indicated at 108, that cooperate with first pair of glide elements 70 to form a first glide system indicated generally at 110 in FIG. 7. In addition to first pair of glide members 108, crisper pan 39 includes a first pair of mounting members 112 defined by an opening 118 provided at an upper rear portion of crisper pan 39. Each opening 118 is bisected by a second opening 120, the function of which will become more fully evident below. Crisper pan 39 also includes a second pair of mounting members, indicated generally at 125, which are formed on opposing side walls 91 and 92. With this arrangement, it should be understood that crisper pan 39 is slidably supported upon support frame 37. That is, glide members 108 rest directly upon first pair of glide elements 70 allowing a consumer to readily withdraw crisper bin 39 from refrigerator 2, while outward travel of crisper bin 39 is limited by stops 80 and 81.

In accordance with a second embodiment of the present invention illustrated in FIGS. 8-15, support frame 37 is provided with a second pair of glide elements 140 which, in the embodiment shown, take the form of wheels or rollers 142 and 143. In accordance with the invention, each wheel/roller 142, 143 includes an integral bearing or pin 144 (FIGS. 11 and 12) which is adapted to cooperate with first pair of mounting elements 73 (FIG. 4) so as to properly position second pair of glide elements 140 with respect to support frame 37. Pin 144 includes first and second hook members 146 and 147 that snap-fittingly engage with first pair of mounting elements 73. Also, each wheel/roller includes a hub 148 and a roller surface 149.

Figure 14:
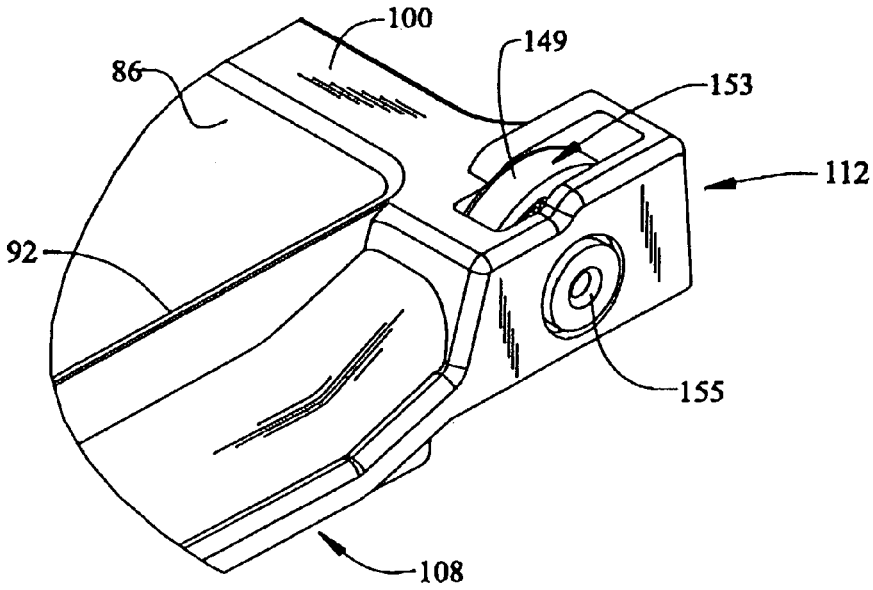
FIG. 14 is an enlarged perspective view of a rear corner portion of the crisper pan of FIG. 10 in accordance with the second embodiment.
Figure 15:
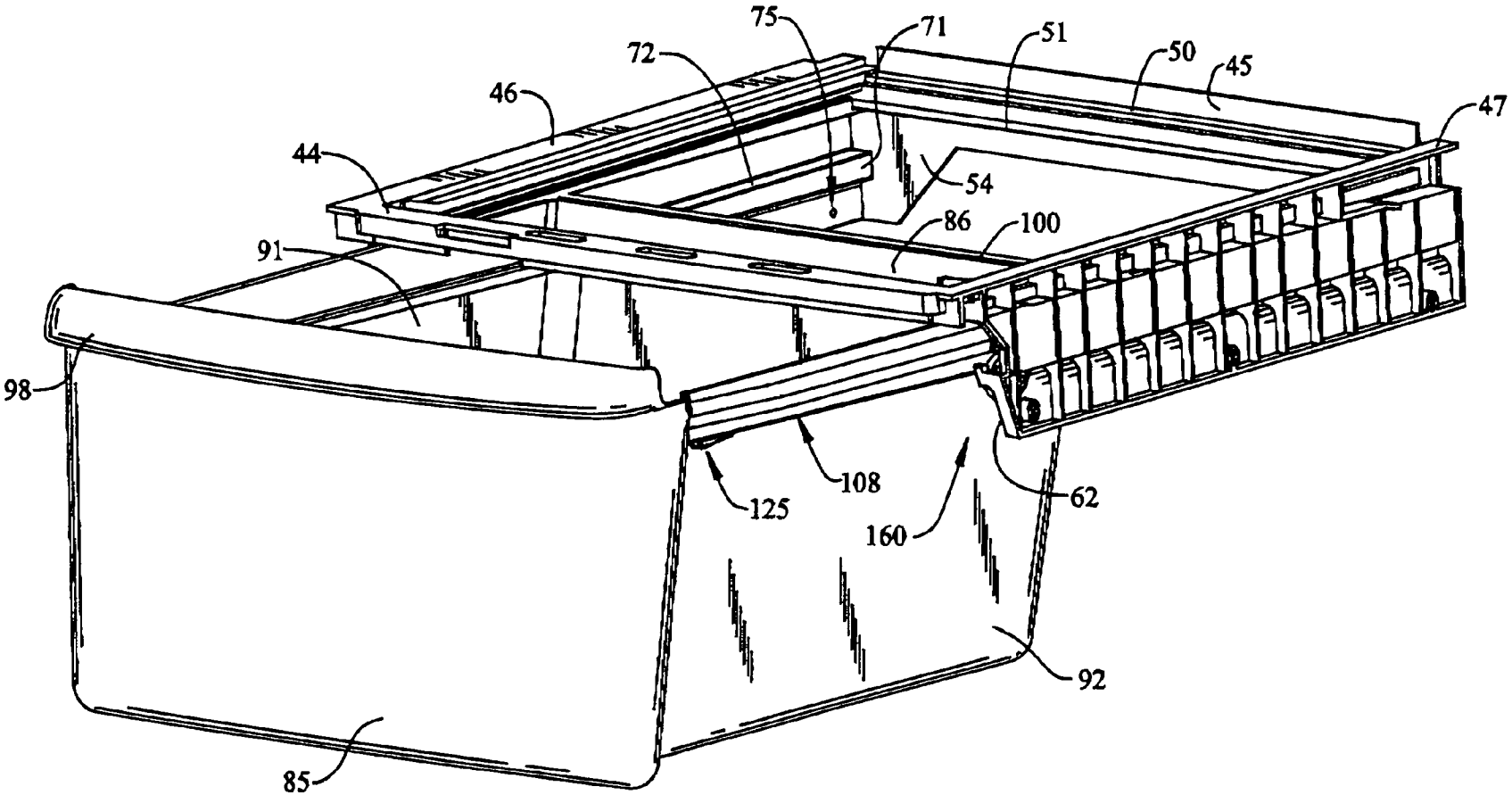
FIG. 15 is a perspective view illustrating the overall refrigerator crisper system assembled in accordance with the second embodiment of the present invention.

In a similar manner, crisper pan 39 includes a second pair of glide members 150 which take the form of wheels/rollers 152 and 153 that are rotatably mounted to the first pair of mounting members 112 with a corresponding pin 154, 155. Second pair of glide elements 140 cooperate with second pair of glide members 150 to form a second glide system 160 illustrated in FIG. 15. As best shown in FIG. 14, wheel 153 is positioned within opening 118 and thereafter secured with pin 155 through second opening 120. Pin 155 serves not only to retain wheel 148 within opening 118 but also provides a bearing or axle surface so that wheel 148 can rotate freely. In accordance with the invention, each wheel 142, 143 and 152, 153 is formed from nylon, while pins 144 and 154, 155 are preferably formed from acetal. In this manner, wheels 142, 143 and 152, 153 can be secured to first pair of mounting elements 73 and first pair of mounting members 112, respectively, without creating stress on either frame 27 or pan 39. That is, forming pins 144, 154 and 155 from acetal provides a more robust bearing and attachment method with a limited likelihood that pins 144, 154 and 155 will crack or otherwise damage mating structure. In any event, each wheel/roller 152, 153 projects through a lower portion of first pair of mounting members 112 to ride along glide surface 72 when crisper pan 39 is shifted relative to frame 37. Likewise, wheel/rollers 142, 143 ride along first pair of glide members 108.

In accordance with the above described embodiment, crisper pan 39 is supported on glide element 70 through wheels 142, 143 and 152, 153. That is, wheels 142, 143 and 152, 153 facilitate the sliding of crisper bin pan 39 relative to support frame 37. As crisper pan 39 is withdrawn from support frame 37, wheels 142 and 143 support a forward portion of crisper pan 39, while wheels 152 and 153 support a rear portion thereof. Actually, wheels 142 and 143 glide along mounting members 125 as crisper pan 39 is withdrawn from support frame 37 so as to provide a continued, rolling support as crisper pan 39 is withdrawn from support frame 37.

Figure 16:
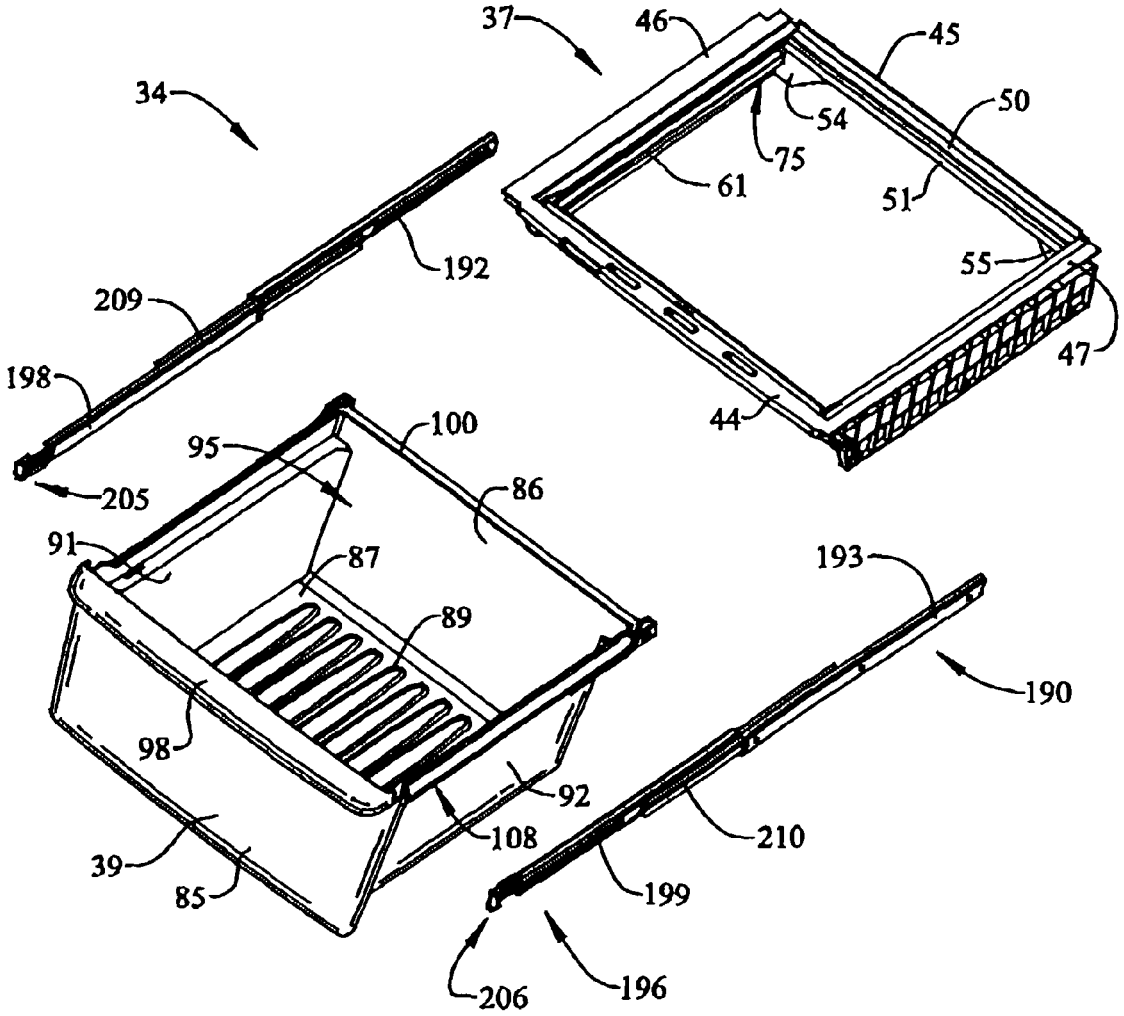
FIG. 16 is an exploded view of the crisper pan and support frame used in combination with a roller bearing glide system in accordance with a third embodiment of the invention.
Figure 17:
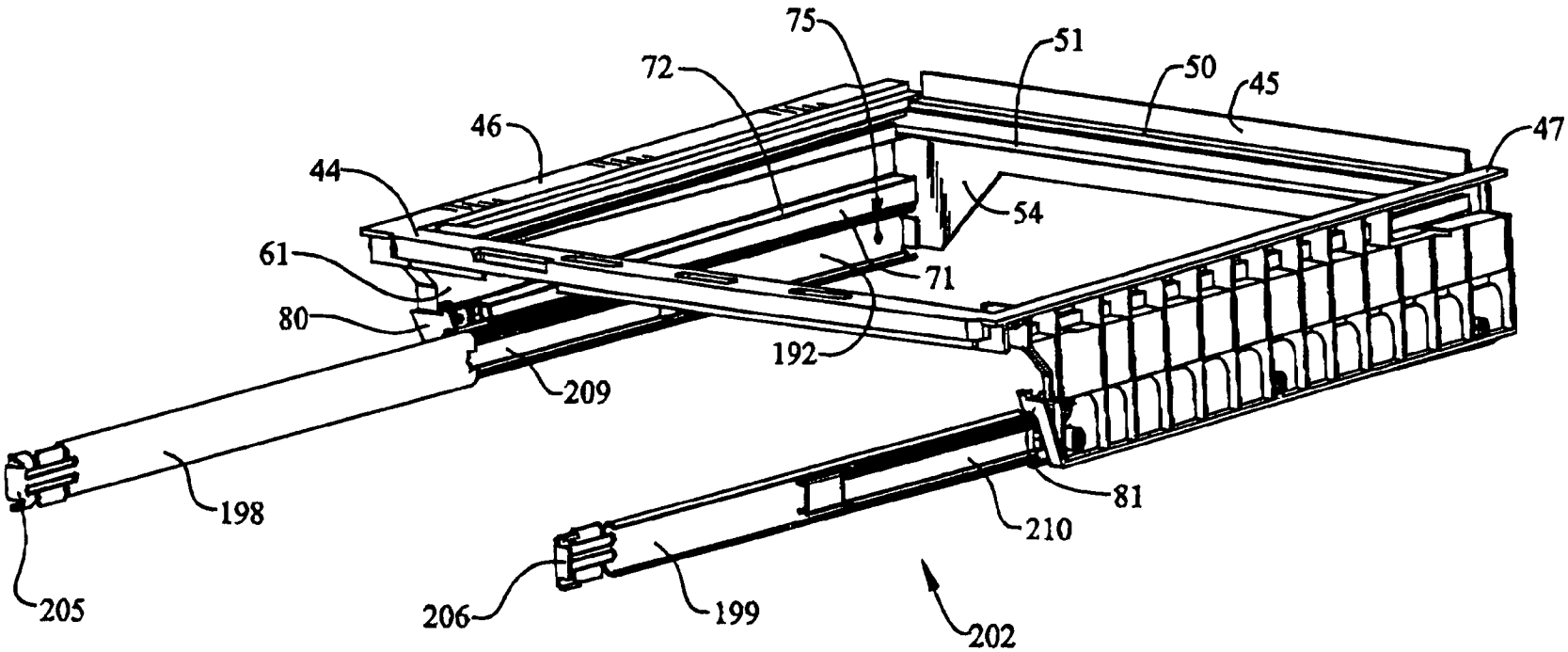
FIG. 17 is a perspective view of the support frame having mounted thereon a roller bearing glide arrangement in accordance with the third embodiment.
Figure 18:
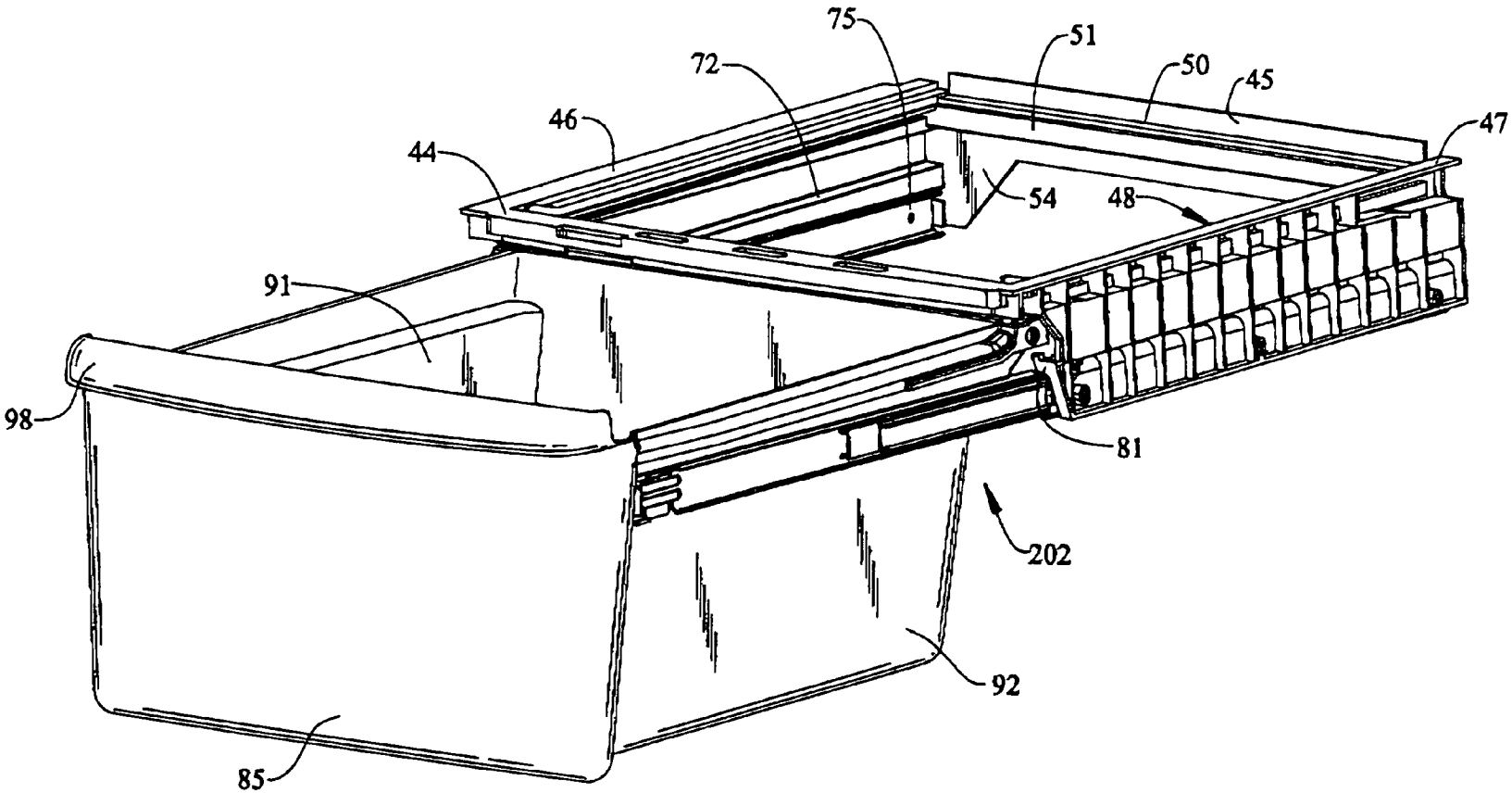
FIG. 18 is a perspective view illustrating the overall refrigerator crisper system assembled in accordance with the third embodiment of the present invention.
Figure 19:
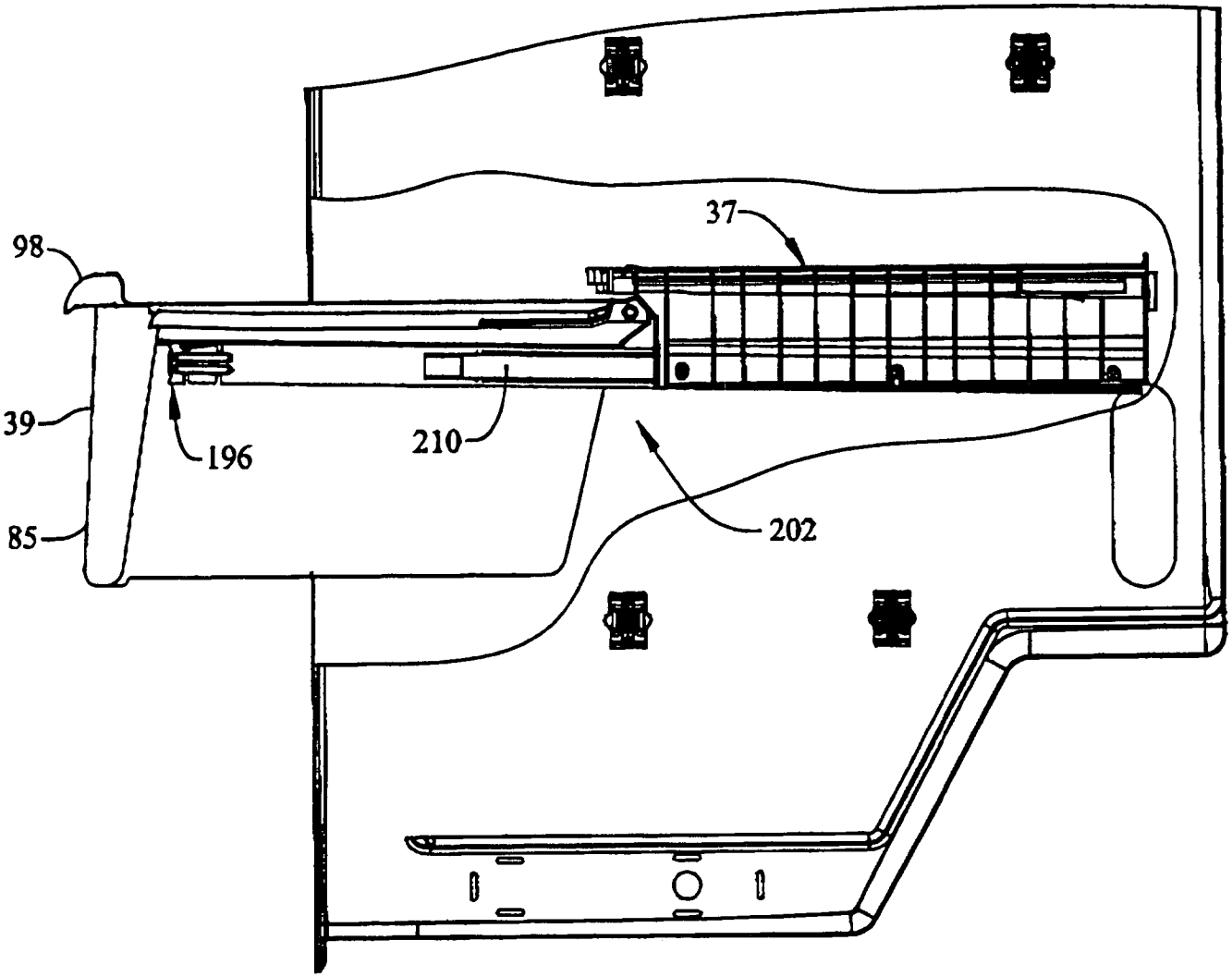
FIG. 19 is a side view depicting mounting details of the refrigerator crisper system to the liner of FIG. 1 in accordance with the third embodiment of the present invention.

Reference will now be made to FIGS. 16-19 in describing a third embodiment of the present invention. As shown, crisper pan system 34 is provided with a third pair of glide elements 190. Third pair of glide elements 190 are constituted by first and second glide rails 192, 193 that are interconnected with a third pair of glide members 196. Third pair of glide members 196 include third and fourth guide rails 198 and 199. In a manner analogous to that described above, third pair of glide elements 190 and third pair of glide members 196 cooperate to form a third glide system 202 which takes the form of extensible glide rails. As best shown in FIG. 16, first and second glide rails 192 and 193 are interconnected to third and fourth glide rails 198 and 199 through intermediate glide rails 209 and 210. In this manner, crisper pan 39 can be withdrawn entirely from refrigerator 2 while still being fully supported by frame 37. In any event, each of third and fourth mounting rails 198 and 199 includes a corresponding attachment element 205, 206, with attachment elements 205 and 206 being adapted to receive second pair of mounting members 125. With this arrangement, crisper pan 39 is detachably mounted to rails 198 and 199 while, at the same time, being shiftable relative to frame 37.

In accordance with this embodiment of the invention, first and second glide rails 192 and 193 are interconnected to the third pair of mounting elements 75 in a manner that ensures third glide system 202 extends at an acute angle to the direction of travel of crisper pan 39. The acute angle enables crisper pan 39 to be withdrawn from crisper pan system 34 without interfering with travel stops 80 and 81, i.e., crisper pan 39 clears travel stops 80 and 81 when extended. In the most preferred embodiment, the acute angle is approximately 1°. More specifically, third glide system 202 is provided with integrated travel limiters (not shown). Accordingly, travel stops 80 and 81 become redundant. However, the location of travel stops 80 and 81 can interfere with the movement of crisper pan 39. Thus, positioning third glide system 202 at an angle relative to support frame 37 enables the use of stop elements 80 and 81 with first and second glide systems 110 and 160 without requiring their removal when third glide system 202 is employed.

Based on the above, it should be understood that the present invention enables a manufacturer to utilize a universal, single support frame with a variety of glide systems depending on particular design requirement and/or consumer needs. Thus, the need for separate or distinct support frames and crisper pans for each type of mounting arrangement is eliminated. In this manner, the overall design of the refrigerator can be simplified, while simultaneously reducing warehousing and manufacturing costs. Although described with reference to preferred embodiments of the invention, it should be readily understood that various changes and/or modifications can be made to the invention without departing from the spirit thereof. For instance, while shown mounted in the fresh food compartment, the crisper drawer system could also be incorporated into a freezer compartment of a refrigerator. In addition, the crisper drawer system could be provided in other refrigerator cabinet styles, such as top mount and bottom mount refrigerators. Finally, it should be understood that the term crisper bin in accordance with the invention encompasses any type of bin, pan or drawer employed in a refrigerator, with or without a separate humidity control. In general, the invention is only intended to be limited by the scope of the following claims.

We claim:

1. A refrigerator comprising:

a cabinet shell having defined therein a refrigerator compartment; and a crisper drawer system mounted within the refrigerator compartment, said crisper drawer system including:

a support frame including front, back and opposing side portions, said opposing side portions including:

a first pair of glide elements;

a first pair of mounting elements for receiving a second pair of glide elements; and a second pair of mounting elements for receiving a third pair of glide elements; and a crisper pan including:

a first pair of glide members;

a first pair of mounting members for receiving a second pair of glide members; and a second pair of mounting members for receiving a third pair of glide members, wherein the first pair of glide elements are adapted to cooperate with the first pair of glide members to form a first glide system, the second pair of glide elements are adapted to cooperate with the second pair of glide members to form a second glide system and the third pair of glide elements are adapted to cooperate with the third pair of glide members of the to form a third glide system, said crisper pan being selectively, slidably supported by the support frame through a select one of the alternatively employed, first, second and third glide systems.

2. The refrigerator according to claim 1, wherein the first glide system constitutes a friction glide system, the second glide system constitutes a roller glide system and the third glide system constitutes an extensible guide rail glide system.

3. The refrigerator according to claim 2, further comprising:

first and second inner rails provided on respective ones of the opposing side portions of the frame, said first pair of glide elements being constituted by longitudinal ribs formed on the first and second inner rails.

4. The refrigerator according to claim 3, further comprising:

at least one stop element provided along one of the first and second inner rails, said at least one stop element limiting a permissible degree of travel of the crisper pan relative to the frame.

5. The refrigerator according to claim 3, wherein the first pair of glide members is provided on opposing side wall portions of the crisper pan.

6. The refrigerator according to claim 3, wherein the first pair of mounting members is constituted by openings formed at an upper rear portion of the crisper pan.

7. The refrigerator according to claim 6, wherein the first pair of mounting elements is constituted by recesses formed at front portions of the first and second inner rails.

8. The refrigerator according to claim 2, wherein the extensible guide rail glide system is mounted at an acute angle relative to an axis of travel of the crisper pan when using the first glide system.

9. The refrigerator according to claim 8, wherein the extensible glide system includes a plurality of extensible roller bearing units.

10. The refrigerator according to claim 1, wherein the second pair of glide members and the second pair of glide elements are constituted by rollers mounted to corresponding ones of the first pair of mounting members and the first pair of mounting elements.

11. The refrigerator according to claim 10, wherein each of the second pair of glide members and the second pair of glide elements includes a pin for securing a respective one of the rollers to a respective one of the first pair of mounting members and the first pair of mounting elements.

12. The refrigerator according to claim 11, wherein the rollers are formed from nylon.

13. The refrigerator according to claim 11, wherein the pin is formed from acetal.

14. The refrigerator according to claim 11, wherein the rollers of the second pair of glide elements include an integral pin.

15. A method of slidably supporting a crisper pan in a refrigerator compartment comprising:

mounting a universal support frame in the refrigerator compartment, with the universal frame being provided with a first pair of glide elements and being adapted to receive second and third pairs of glide elements;

selecting one of a plurality of glide systems for shiftably supporting the crisper pan to the support frame on a respective one of the first, second and third pairs of glide elements; and supporting the crisper pan on the support frame through the selected one of the plurality of glide systems.

16. The method of claim 15, wherein the plurality of glide systems are constituted by a friction glide system, a roller glide system and an extensible rail glide system.

17. The method of claim 16, further comprising:

directly supporting the crisper pan on first and second inner rails of the support frame when the friction glide system is selected.

18. The method of claim 16 further comprising:

supporting the crisper pan by a plurality of rollers on first and second inner rails of the support frame when the roller glide system is selected.

19. The method of claim 16, further comprising:

mounting the crisper pan to the support frame through first and second extensible glide rails when the extensible glide system is selected.

20. The method of claim 19, further comprising:

arranging the extensible glide system at an acute angle relative to the support frame.

* * * * *